US006511283B1

(12) United States Patent
Yoshioka

(10) Patent No.: US 6,511,283 B1
(45) Date of Patent: Jan. 28, 2003

(54) ELECTRIC FUEL PUMP

(75) Inventor: Hiroshi Yoshioka, Tokyo (JP)

(73) Assignee: Mitsubishi DenkiKabushiki Kaisha, Tokyo (JP)

( * ) Notice: Subject to any disclaimer, the term of this patent is extended or adjusted under 35 U.S.C. 154(b) by 0 days.

(21) Appl. No.: 09/959,938

(22) PCT Filed: Mar. 10, 2000

(86) PCT No.: PCT/JP00/01480

§ 371 (c)(1),
(2), (4) Date: Nov. 13, 2001

(87) PCT Pub. No.: WO01/66930

PCT Pub. Date: Sep. 13, 2001

(51) Int. Cl.[7] ..... F04D 5/00
(52) U.S. Cl. ..... 415/55.1
(58) Field of Search ..... 415/55.1, 55.2, 415/55.3, 55.4

(56) References Cited

U.S. PATENT DOCUMENTS

| | | | | | |
|---|---|---|---|---|---|
| 4,141,674 | A | * | 2/1979 | Schonwald | 415/55.1 |
| 5,123,809 | A | * | 6/1992 | Ito | 415/55.1 |
| 5,174,713 | A | | 12/1992 | Iwai et al. | 415/55.1 |
| 5,209,630 | A | * | 5/1993 | Roth | 415/55.1 |
| 5,221,178 | A | | 6/1993 | Yoshioka et al. | 415/55.1 |
| 5,372,475 | A | * | 12/1994 | Kato et al. | 415/55.1 |
| 5,375,970 | A | | 12/1994 | Iwai et al. | 415/55.1 |
| 6,299,406 | B1 | * | 10/2001 | Yu et al. | 415/55.1 |
| 6,322,319 | B1 | * | 11/2001 | Yoshioka | 415/55.1 |

FOREIGN PATENT DOCUMENTS

| | | | |
|---|---|---|---|
| JP | 63-63756 | 12/1988 | F04D/5/00 |
| JP | 2-103194 | 8/1990 | F04D/5/00 |
| JP | 6-159283 | 6/1994 | F04D/5/00 |
| JP | 6-229388 | 8/1994 | F04D/5/00 |

* cited by examiner

*Primary Examiner*—John E. Ryznic
(74) *Attorney, Agent, or Firm*—Sughrue Mion, PLLC

(57) ABSTRACT

An electric fuel pump for supplying fuel by rotationally driving an impeller (30) within a pump flow path (13) with the aid of a motor section (3), wherein vane segments (31A, 31B) of the impeller (30) are staggered by a prescribed distance (d) at the front and rear and circumferentially of the impeller (30), guiding faces (31*a*, 31*b*) which extend from the sides of the end faces to the outermost periphery of the impeller (30) are formed in the staggered portions, and partitions (32) are provided between the a adjacent vanes (31), each of the partitions having guiding faces (32*a*, 32*b*) on the sides of the end faces of the impeller (30) and an outermost peripheral face (32*c*) located more inwardly than the outermost peripheral face (31*c*) of the vane (31). In such a configuration, the vane segments (31A, 31B) do not simultaneously collide with the end face (9*b*) of the radial sealing portion (9*a*) so that the noise due to fuel collision can be reduced and the pumping efficiency can be improved.

3 Claims, 4 Drawing Sheets

ELECTRIC FUEL PUMP

TECHNICAL FIELD

This invention relates to an electric fuel pump which is installed within a fuel tank of e.g. a motor vehicle, and pressure-supplies fuel to the engine, and more particularly to an electric fuel pump with a characteristic of low noise and high efficiency.

BACKGROUND ART

FIGS. 4 and 5 are a partially enlarged perspective view of an impeller and an enlarged perspective view of the vicinity of a radial sealing portion of a pump base of a conventional electric fuel pump disclosed in e.g. Japanese Patent Public. No. 63-63756, respectively.

In the figures, reference numeral 10 denotes an impeller equipped with a number of vanes 21 on the outer periphery of a disk shape. Each vane is divided into a front and rear segments by a partition 22. A vane groove 23 is formed between the respective vanes 21. Reference numeral 9 denotes a pump base constituting a pump casing (not shown) which includes an arc belt-shaped pump flowpath 13, a sucking inlet 4, a discharge outlet 15, a radial sealing portion 9*a* for preventing the backflow of the fuel and an end face 9*b* which converts the direction of flowing of the fuel.

When the impeller 10 rotates within the pump casing (not shown), the fuel sucked from the sucking inlet 14 flows into each of the vane grooves 23, The fuel is passed through the pump flowpath 13 under kinetic energy from each of the vanes 21, and pressure-supplied to the discharge outlet 15. The fuel pressure-supplied to the discharge outlet 15 collides with the end face 9*b* of the radial sealing portion 9*a* formed at the end of the pump flowpath 13 and discharged from the discharge outlet 15 while it changes the direction.

In such a structure, the fuel supplied into the left and right vane grooves 23 divided into the front and rear portions by the partition 22 simultaneously collides with the end face 9*b* of the radial sealing portion 9*a*. This presents a problem of increasing noise due to the fuel collision.

An example of the measure for solving this problem is disclosed in FIGS. 6 and 7 of JP-A-159283. In the pump base 9 constituting the pump casing (not shown) of the illustrated structure, the end face 9*b* of the radial sealing portion 9*a* is given a step 9*c* so that the timing of fluid collision is displaced to reduce the noise. In addition, the outer periphery of the vane 21 is projected more outwardly than the outer periphery of the partition 22 so that a backflow area (area impeding the pumping operation) is prevented from being created just on top of the partition, thereby improving the pumping efficiency.

In recent years, the needs of reducing the operation noise and mileage have been enhanced. Correspondingly, as described above, the conventional electric fuel pumps have adopted the measures of changing the respective shapes of the impeller and pump base to reduce the operation noise and improve the pump efficiency. However, the pump base, which is generally made of aluminum die-casting from the point of view of dimensional accuracy and mechanical strength, has presented a problem of requiring a huge amount of cost to repair and manufacture a mold product. Further, it is desirable that in order to reduce the operating noise, the step 9*c* is given on both sides of the sucking inlet and discharge outlet of the pump casing. However, it was difficult to provide a pump casing having such a structure by molding.

This invention has been made in order to solve the above problems, and intends to provide an electric fuel pump which can reduce the noise during a pump operation and gives high pumping efficiency.

DISCLOSURE OF THE INVENTION

The electric fuel pump according to this invention comprises a disk-shaped impeller including a number of vanes (31) formed at its outer edge and projected circumferentially, partitions (32) extended between the vanes (31) and vane grooves (33) formed by the partitions (32) and the vanes (31) provided at the front and rear of the partitions (32); a motor section (3) for rotationally driving the impeller (30); and a pump casing (7) which houses the impeller (30), forms an arc belt-shaped pump flow path (13) extending along the outer edge of the impeller (30), and has a sucking inlet (14) at the one end of the pump flow path (30) and a discharge outlet (15) at the other end thereof, and is characterized in that each of the vanes (31) includes a vane segment (31A) on the side of the one end face of the impeller (30) and a vane segment (31B) on the side of the other end face of the impeller (30), the vane segment (31A) on the side of the one end face and the vane segment (31B) on the side of the other end face are staggered by a prescribed distance (d) circumferentially of the impeller (30), and in the vane segment (31A) on the side of the one end face and the vane segment (31B) on the side of the other end face, guiding faces (31*a*, 31*b*) are formed which extend from the sides of the one end face and the other end face of the impeller (30) to the outermost periphery of the impeller (30) to guide fuel; each of the partitions (32) has guiding faces (32*a*, 32*b*) which extend from the sides of the one end face and the other end face of the impeller (30) to guide the fuel; and each of the vane grooves (33) includes a groove segment (33A) formed by a guiding face (31*b*) which extends from the side of the one end face of the impeller (30) to the outermost periphery of the impeller (30) to guide the fuel and the vane segment (31A) on the side of the one end face of the impeller; a groove segment (33B) formed around the partition (32) where both guiding faces (32*a*, 32*b*) of the partition (32) are opposite to each other; and a groove segment (33C) formed by a guiding face (31*a*) which extends from the side of the other end face of the impeller (30) to the outermost periphery of the impeller (30) to guide the fuel and the vane segment (31B) on the side of the other end face.

In the electric fuel pump, an outermost peripheral face (32*c*) of the partition (32) is located more inwardly than the outermost peripheral face (31*c*) of the vane (31). In the electric fuel pump, the outermost periphery of each of the guiding faces (31*a*, 31*b*) is coincident with a center line of the impeller (30) in the direction of thickness.

BEST MODE FOR CARRYING OUT THE INVENTION

Figure 1:
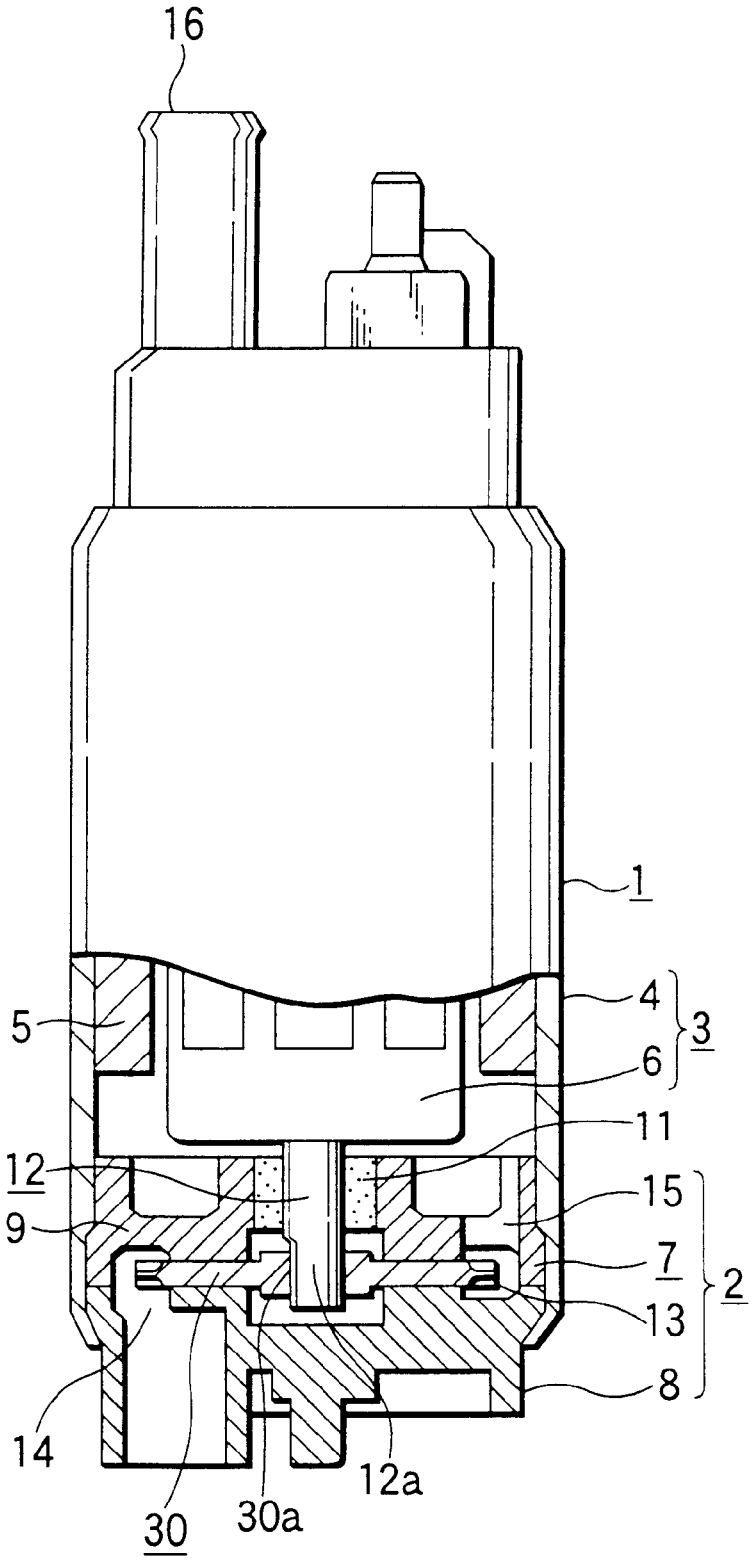
FIG. 1 is a partially broken side view of an electric fuel pump according to an embodiment of this invention.
Figure 2:
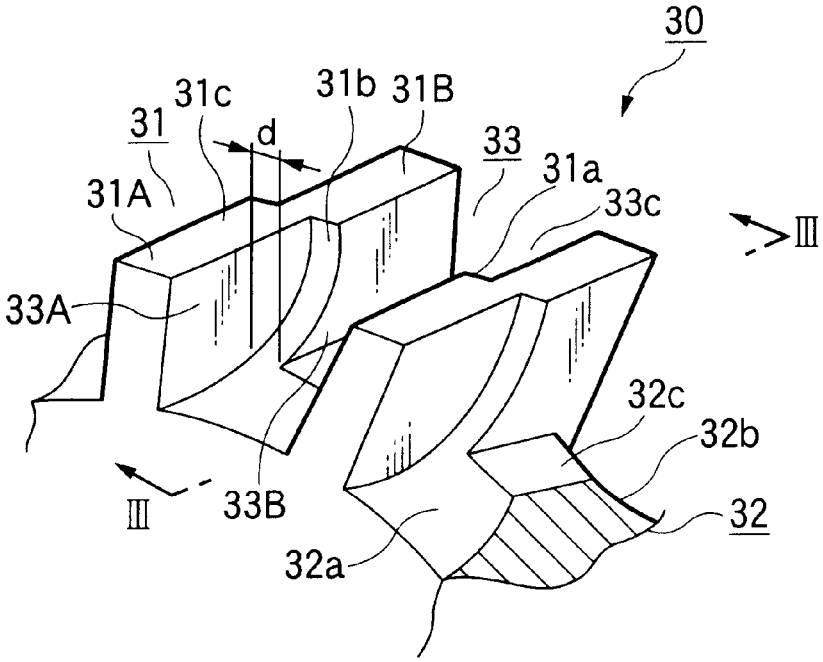
FIG. 2 is an enlarged perspective view of a vane portion of an impeller of the electric fuel pump according to the embodiment of this invention.
Figure 3:
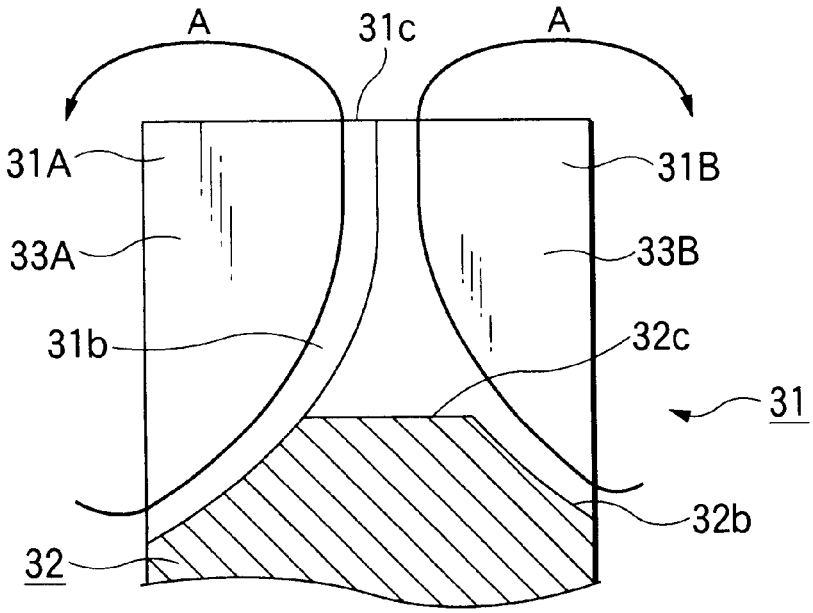
FIG. 3 is an enlarged sectional view of the vane portion of the impeller in FIG. 2 taken in line III—III.
Figure 4:
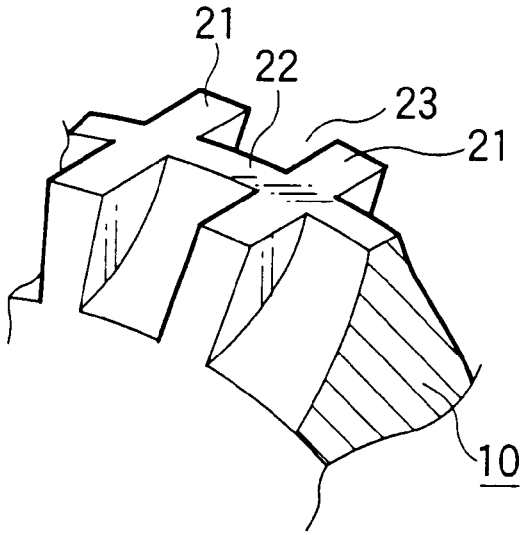
FIG. 4 is a partially enlarged perspective view of a vane portion of an impeller of a conventional electric fuel pump.

FIG. 1 is a partially broken side view of an electric fuel pump according to an embodiment of this invention. FIG. 2 is an enlarged perspective view of a vane portion of an impeller of the electric fuel pump. FIG. 3 is an enlarged sectional view of the vane portion of the impeller in FIG. 2 taken in line III—III. Now referring to FIGS. 1 to 3, an explanation will be given about the embodiment of this invention. An electric fuel pump 1 includes a pump section 2 and a motor section 3 for driving the pump section 2. The motor section 3 has for example, a DC motor equipped with a brush (not shown) and is structured so that a permanent magnet is arranged annually within a cylindrical housing 4 and a armature 6 is arranged concentrically on the inner periphery of the permanent magnet 5.

The pump section 2 includes a pump casing 7 composed of a pump cover 8 and a pump base 9, and an impeller 30 housed within the pump casing 7. The pump cover 8 and pump base 9 are formed by e.g. aluminum-die casting molding or resin molding.

The pump base 9 is fixedly press-fit into the one end of the housing 4, and a bearing 11 fit into the center of the pump base supports a rotary shaft 12 formed integrally to the armature 6 so that the armature shaft penetrates through the bearing 11. On the other hand, the bump cover 8 is secured to the one end of the housing 4 by caulking and the like in a state where it is covered with the pump base 9.

A substantially D-shaped insertion hole 30*a* is formed at the center of the impeller 30. A D-cutting portion 12*a* of the rotary shaft 12 is loosely inserted into the insertion hole 30*a*. Thus, the impeller 30 is rotated simultaneously with the rotary shaft 12 and slidable in the axial direction of the shaft 12.

Figure 5:
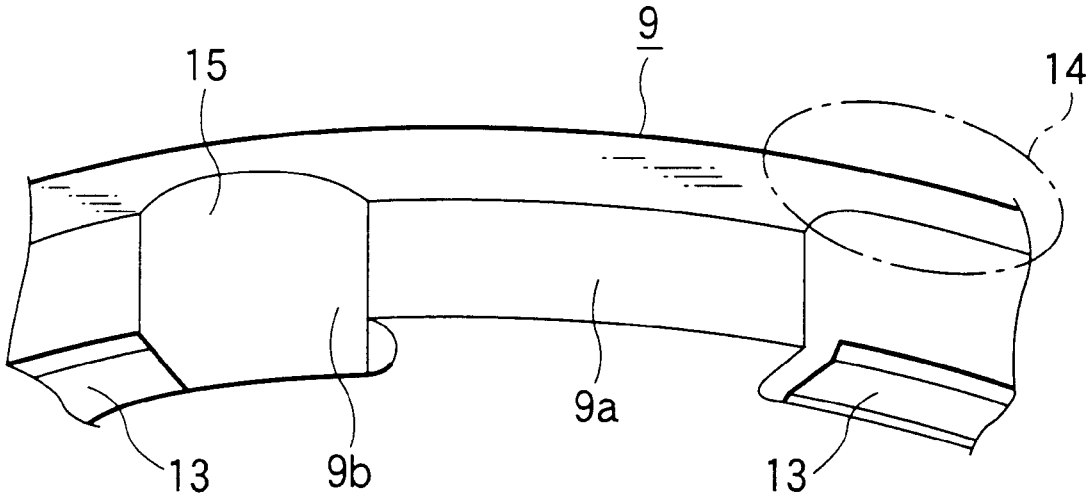
FIG. 5 is an enlarged perspective view of the vicinity of a radial sealing portion of a pump base of the conventional electric fuel pump.
Figure 6:
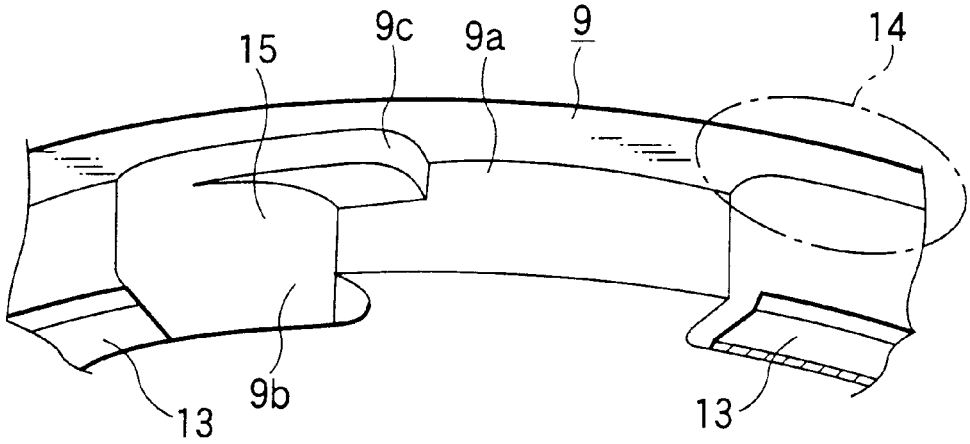
FIG. 6 is an enlarged perspective view of the vicinity of a radial sealing portion of a pump base of another conventional electric fuel pump.
Figure 7:
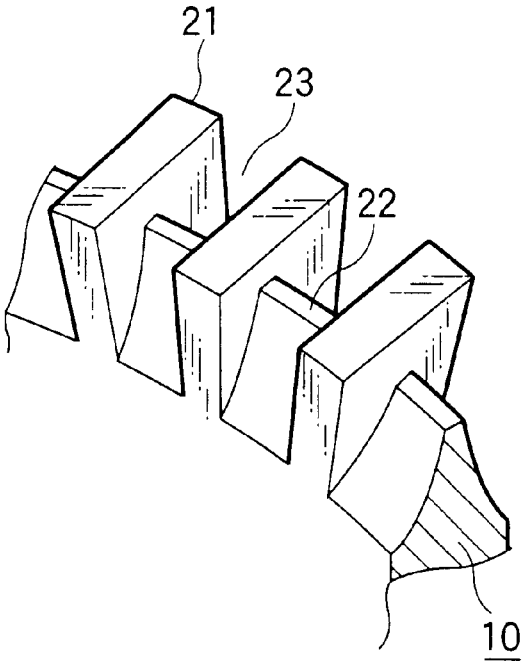
FIG. 7 is an enlarged perspective view of a vane portion of an impeller of the conventional electric fuel pump.

Inside the pump cover 8 and pump base 9 constituting the pump casing 7, an arc belt-shaped pump flow path 13 is formed. A sucking inlet 14 communicating to the one end of the pump flow path 13 is formed in the pump cover 8, and a discharge outlet 15 communicating to the pump flow path 13 is formed in the pump base 9. A radial sealing portion 9*a* (FIG. 5) for preventing backflow is formed between the sucking inlet 14 and the discharge outlet 15. The discharge outlet 15 is communicated to the space within the motor 3 so that the fuel discharged from the discharge outlet 15 passes through the motor section 3 and pressure-supplied to an engine (not shown) through a fuel outlet pipe 16 provided adjacently to the motor section 3.

The impeller 30 is integrally formed of e.g. phenol resin and has vanes 31 and (vane) grooves 31 alternately located circumferentially on the outer periphery. Each vane 31 is composed of a vane segment 31A on the side of the one end face of the impeller 30 and another vane segment 31B on the side of the other end face of the impeller 30. The vane segment 31A and vane segment 31B are staggered by a prescribed distance d, e.g. half of the circumferential length of the vane 31 circumferentially of the impeller 30. In the vane segment 31A on the side of the one end face of the impeller 30, a guiding face 31*a* is formed which extends from the side of the other end face of the impeller 30 to the outermost periphery of the impeller 30 to guide fuel. Likewise, in the vane segment 31B on the side of the other end face of the impeller 30, a guiding face 31*b* is formed which extends from the side of the one end face of the impeller 30 to the outermost periphery of the impeller 30 to guide fuel. The outermost periphery of each of the guiding faces 31*a* and 31*b* are coincident with the center line of the impeller 30 in the thickness direction thereof.

A partition 32 has guiding faces 32*a*, 32*b* which extend from the one end face and other end face of the impeller 30, respectively to guide fuel and an outermost face 32*c* located more inwardly than the outermost periphery 31*c* of the vane 31.

The guiding faces 32*a* and 32*b* of the partition 32 are made at a prescribed curvature in e.g. a radial direction of the impeller 30 so that they become closer to each other toward the outer periphery of the impeller 30. Further, the guiding faces 32*a* and 32*b* of the partition 32 are made to have the same facial shape as those of the guiding surfaces 31*b* and 31*a* of the vane segments 31B and 31A. Namely, the guiding faces 32*a* and 32*b* of the partition 32 are made with the same curvature from the base portion of the vane 31 of the guiding faces 31*b* and 31*a* of the vane segments 31B and 31A to the outermost periphery 32*c* of the partition 32. The outermost face 32*c* of the partition 32 is a flat face.

The groove 33 is composed of a groove segment 33A formed by the guiding face 31*b* and vane segment 31A; a groove segment 33B which is a space between the adjacent vanes 31 formed around the partition 32 where both guiding face 32*a* and 32*b* are opposite to each other, i.e. with an interface of the both guiding faces 32*a*, 32*b* and the outermost face 32*c*; and a groove 33C formed between the guiding face 31*a* and vane segment 31B.

An explanation will be given of the operation of the electric fuel pump structured as described above.

When the coil (not shown) of the armature 6 of the motor section 3 is energized, the armature 6 rotates so that the rotary shaft 12 formed integrally to the armature 6 and the impeller 30 having an insertion hole 30*a* engaged with the D-cut portion 12*a* of the rotary shaft 12 rotate. Thus, the vanes 31 on the outer periphery of the impeller 30 rotate along the arc belt-shaped pump flow path 13. As a result, a circulating flow A is generated in the groove 33. The grooves 33 rotate in the pump flow 13 path so that kinetic energy is increased to create a pumping operation.

Accordingly, the fuel within the fuel tank (not shown) is sucked from the sucking inlet 14 into the pump flow path 13 and the fuel flows into each of the grooves 33. After the fuel rotationally moves in the pump flow path 13, it is pressure-supplied toward the discharge outlet 15. The fuel passes through the motor section 3 and pressure-supplied to the engine (not shown) via the fuel outlet pipe 16.

As described above, since the vane segments 31A and 31B are staggered by a prescribed distance d circumferentially of the impeller 30, an electric fuel pump with low noise during a pumping operation and high pumping efficiency can be provided. Further, such a characteristic can be realized in the structure shown in FIG. 5 without changing the shape of the pump casing.

Specifically, the fuel in the groove segment 33A located at the one end face of the impeller 30 is guided along the guiding face 32*b* of the vane segment 31B located at the other end face of the impeller 30. In this case, the guiding face 32*b* extends to the outermost periphery of the impeller 30 so that a circulating flow A is effectively generated. Likewise, since the guiding face 32*a* extends to the outermost periphery of the impeller 30, the circulating flow A is effectively generated. Further, since the outermost face 32*c* of the partition 32 is located more inwardly than the outermost periphery of the impeller 30, a back flow zone (zone disturbing the pumping operation) is difficult to occur just on top of the outermost face of the partition 32. These two functions improve the pumping efficiency. In addition, the outermost periphery of each of the guiding faces 31*a* and 31*b* is coincident with the center line of the impeller 30 in the thickness direction so that the circulating flows A can smoothly join each other. In this way, the circulating flow A can be effectively generated.

Further, since the vane segments 31A and 31B are staggered by a prescribed distance d circumferentially of the impeller 30, the fuels residing in the vane grooves 33 at the front and rear of the impeller 30 collide with the end face 9*b* of the radial sealing portion 9*a* (see FIG. 5) at different timings. Therefore, while the electric fuel pump operates, sound is scattered mainly into the two frequency bands so that the noise is reduced at the time of fuel collision. Further, since the vane segments 31A and 31B are staggered by a prescribed distance d, e.g. half of the circumferential length of the vane 31 circumferentially of the impeller 30, the sound is generated mainly in the two frequency bands. In this case, the higher frequency band has a frequency several times as high as that of the lower frequency band, the higher frequency can be easily located outside an audible sound range.

Industrial Applicability

The electric fuel pump comprises a disk-shaped impeller (30) including a number of vanes (31) formed at its outer edge and projected circumferentially, partitions (32) extended between the vanes (31) and vane grooves (33) formed by the partitions (32) and the vanes (31) provided at the front and rear of the partitions (32); a motor section (3) for rotationally driving the impeller (30); and a pump casing (7) which houses the impeller (30), forms an arc belt-shaped pump flow path (13) extending along the outer edge of the impeller (30), and has a sucking inlet (14) at the one end of the pump flow path (30) and a discharge outlet (15) at the other end thereof, and is characterized in that each of the vanes (31) each includes a vane segment (31A) on the side of the one end face of the impeller (30) and a vane segment (31B) on the side of the other end face of the impeller (30), the vane segment (31A) on the side of the one end face and the vane segment (31B) on the side of the other end face are staggered by a prescribed distance (d) circumferentially of the impeller (30), and in the vane segment (31A) on the side of the one end face and the vane segment (31B) on the side of the other end face, guiding faces (31*a*, 31*b*) are formed which extend from the sides of the one end face and the other end face of the impeller (30) to the outermost periphery of the impeller (30) to guide fuel; each of the partitions (32) each has guiding face (32*a*, 32*b*) which extend from the sides of the one end face and the other end face of the impeller (30) to guide the fuel; and the grooves (33) each includes a groove segment (33A)formed by a guiding face (31*b*) which extends from the side of the one end face of the impeller (30) to the outermost periphery of the impeller (30) to guide the fuel and the vane segment (31A) on the side of the one end face of the impeller; a groove segment (33B) formed around the partition (32) where both guiding faces (32*a*, 32*b*) of the partition (32) are opposite to each other; and a groove segment (33C) formed by a guiding face (31*a*) which extends from the side of the other end face of the impeller (30) to the outermost periphery of the impeller (30) to guide the fuel and the vane segment (31B) on the side of the other end face. Such a configuration can provide the electric fuel pump which reduces the noise during a pumping operation and high pumping efficiency.

In the electric fuel pump, an outermost peripheral face (32*c*) of the partition (32) is located more inwardly than the outermost peripheral face (31*c*) of the vane (31). Such a configuration can provides the electric fuel pump which gives higher pumping efficiency.

In the electric fuel pump, the outermost periphery of each of the guiding faces (31*a*, 31*b*) is coincident with a center line of the impeller (30) in the direction of thickness. Such a configuration can provide the electric fuel pump which gives higher pumping efficiency.

What is claimed is:

1. An electric fuel pump comprising:

a disk-shaped impeller (30) including:

a number of vanes (31) formed at the outer edge thereof and projected circumferentially;

a plurality of partitions (32) extended between the vanes (31); and a plurality of vane grooves (33) formed by the partitions (32) and the vanes (31) provided at the front and rear of the partitions (32);

a motor section (3) for rotationally driving the impeller (30); and a pump casing (7) which houses the impeller (30), forms an arc belt-shaped pump flow path (13) extending along the outer edge of the impeller (30), and has a sucking inlet (14) at the one end of the pump flow path (30) and a discharge outlet (15) at the other end thereof, wherein each of the vanes (31) each includes a vane segment (31A) on the side of the one end face of the impeller (30) and a vane segment (31B) on the side of the other end face of the impeller (30);

the vane segment (31A) on the side of the one end face and the vane segment (31B) on the side of the other end face are staggered by a prescribed distance (d) circumferentially of the impeller (30), and in the vane segment (31A) on the side of the one end face and the vane segment (31B) on the side of the other end face;

a plurality of guiding faces (31*a*, 31*b*) are formed which extend from the sides of the one end face and the other end face of the impeller (30) to the outermost periphery of the impeller (30) to guide fuel;

the partitions (32) each has guiding face (32*a*, 32*b*) which extend from the sides of the one end face and the other end face of the impeller (30) to guide the fuel; and the grooves (33) each includes:

a groove segment (33A) formed by a guiding face (31*b*) which extends from the side of the one end face of the impeller (30) to the outermost periphery of the impeller (30) to guide the fuel and the vane segment (31A) on the side of the one end face of the impeller;

a groove segment (33B) formed around the partition (32) where both guiding faces (32*a*, 32*b*) of the partition (32) are opposite to each other; and a groove segment (33C) formed by a guiding face (31*a*) which extends from the side of the other end face of the impeller (30) to the outermost periphery of the impeller (30) to guide the fuel and the vane segment (31B) on the side of the other end face.

2. The electric fuel pump according to claim 1, wherein an outermost peripheral face (32*c*) of the partition (32) is located more inwardly than the outermost peripheral face (31*c*) of the vane (31).

3. The electric fuel pump according to claim 1, wherein the outermost periphery of the guiding faces (31*a*, 31*b*) are coincident with a center line of the impeller (30) in the direction of thickness.

* * * * *